US005604948A

United States Patent [19]

McMahon et al.

[11] Patent Number: 5,604,948

[45] Date of Patent: Feb. 25, 1997

[54] IMPACT TERMINATION TOOL CONFIGURED FOR TORQUE APPLICATIONS

[75] Inventors: Kenneth L. McMahon, Newbury Park; Robert W. Sullivan, Simi Valley, both of Calif.

[73] Assignee: Harris Corporation, Melbourne, Fla.

[21] Appl. No.: 231,576

[22] Filed: Apr. 22, 1994

[51] Int. Cl.[6] ..... B25B 15/00

[52] U.S. Cl. ..... 7/165; 7/108; 7/142; 29/566.4; 81/439

[58] Field of Search ..... 81/437–439, 177.4, 81/180.1, 185.2, 181, 490; 7/165, 107, 108, 142; 29/566.4, 275, 751

[56] References Cited

U.S. PATENT DOCUMENTS

| | | | |
|---|---|---|---|
| 1,935,748 | 11/1933 | Roff | 81/438 |
| 2,022,775 | 12/1935 | Holland-Letz | 81/439 |
| 4,161,061 | 7/1979 | Mason et al. | 29/566.4 |
| 4,779,493 | 10/1988 | White | 81/439 X |
| 5,341,705 | 8/1994 | Lin | 81/439 X |

FOREIGN PATENT DOCUMENTS

| | | | |
|---|---|---|---|
| 718990 | 11/1954 | United Kingdom | 81/439 |

*Primary Examiner*—D. S. Meislin
*Attorney, Agent, or Firm*—Charles E. Wands

[57] ABSTRACT

The slide element of a termination tool is modified to include an outer torque/slide body portion, thereby forming a combination—torque and slide—element, which provides the auxiliary capability of imparting torque to an engageable hardware element, such as slotted end or cross-point end screwdriver bit, thereby enabling the tool used to drive commonly used hardware fasteners. The interior bore of the handle in which a slide element is normally axially translatable is modified to capture respective halves of a protective sleeve element. The protective sleeve element is shaped to conform with the shape of a torque/slide body portion of the torque/slide element. The torque/slide element is preferably metallic (e.g. steel) and is generally cylindrically shaped, having a longitudinal axis that is alignable with the longitudinal axis of the tool.

14 Claims, 3 Drawing Sheets

IMPACT TERMINATION TOOL CONFIGURED FOR TORQUE APPLICATIONS

FIELD OF THE INVENTION

The present invention relates in general to a termination tool used for terminating electrical conductors at telephone equipment terminal blocks, and is particularly directed to a new and improved tool configuration that allows the tool to be used for both impact insertion and torque applications.

BACKGROUND OF THE INVENTION

Telephone craftspersons employ impact termination tools for installing and terminating electrical conductors at terminal blocks of telephone equipment installations. FIG. 1 diagrammatically illustrates a non-limitative example of such a termination tool, corresponding to that described in the Mason et al, U.S. Pat. No. 4,161,061, assigned to the assignee of the present application and the disclosure of which is herein incorporated. As shown in FIG. 1, such a tool 11 is of the type used to connect an electrical conductor to a terminal, and is comprised of a manually engageable handle 13, a forward end 15 of which has a longitudinal bore 16 which contains a slide element 17 that is axially translatable within the bore. The slide element itself is configured to retain a termination blade 21, the termination blade having a tip 23 which conforms with the shape of a terminal located on a terminal block (not shown) used in terminating electrical conductors such as telephone wires at terminal posts or clips. The tool is further internally equipped with an impact mechanism, shown diagrammatically at 25, which is positioned to controllably deliver an impact blow to a cylindrical pin portion 27 of slide element 17 and thereby cause the termination blade to insert a wire into a terminal. Advantageously, the configuration of the patented slide element provides for rapid manual interlock and removal of the termination blade 21 from the slide element 17, and also allows for substantial lateral loading (transverse to the longitudinal axis of the tool) of the blade during use.

As those working in the technology are aware, increasing demands for better efficiency and reduction in service overhead have made it desirable to integrate as many functions as possible in a given piece of service equipment. Since a termination tool is configured as a manual hand tool, having a handle and metallic shaft extension that has been conventionally configured to capture and axially manipulate a specially shaped workpiece modifying element (termination blade), it would be advantageous and constitute a more efficient use of the tool, if a terminal insertion tool had the additional capability of performing auxiliary functions, so as to limit the need for the craftsperson to carry additional tools dedicated for the purpose. In particular, it is desirable that the tool be versatile enough to perform rotational (torque) functions, so that commonly used hardware fasteners, such as slotted and Phillips head bolts and screws, may be removed and installed using the termination tool.

SUMMARY OF THE INVENTION

In accordance with the present invention, the above described desirability of providing a termination tool with the auxiliary capability of providing torque to an engageable hardware element is successfully addressed by means of a new and improved 'torque'/slide modification of a conventional termination tool, such as the tool disclosed in the above-referenced Mason et al patent. More particularly, the present invention is directed to the addition of an outer torque/slide body portion to the slide element of a termination tool of the type used to connect an electrical conductor, such as a telephone wire to a terminal post or clip, and thereby provides the slide element, and thus the tool proper, with the auxiliary capability of imparting torque to an engageable hardware element, such as slotted end or cross-point end screwdriver bit, thereby enabling the tool used to drive commonly used hardware fasteners.

For this purpose, the improved termination tool in accordance with the present invention comprises a combination—torque and slide—element, hereinafter simply referred to as a torque/slide element, which is configured to retain both a termination blade and a torque (e.g. screwdriver bit) element. The interior bore of the handle in which a slide element is normally axially translatable is modified to capture respective halves of a protective sleeve element. The protective sleeve element is shaped to conform with the shape of a torque/slide body portion of the torque/slide element. The torque/slide element is preferably metallic (e.g. steel) and is generally cylindrically shaped, having a longitudinal axis that is alignable with the longitudinal axis of the tool.

A forward annular end of the torque/slide element opens into a longitudinal bore which has a first diameter portion that extends to a first prescribed depth along the longitudinal axis from the forward end of the torque/slide element. Continuous with this first diameter portion is a second diameter portion of a slightly reduced diameter relative to the first diameter, so as to form an interior annular shoulder region against which a screwdriver bit may rest in its installed or captured position in the torque/slide element. The Second diameter portion has a depth sufficient to accommodate the length of an interior-facing one of the two opposing blade portions of the screwdriver bit element, when the screwdriver bit element is installed in the torque/slide element.

Located generally axially midway along the length of the outer body surface of the torque/slide element is a raised torque/slide body portion, having a generally regular polygon shape. A rearward end of the torque/slide element has a cylindrical pin which is arranged to receive an axial blow from an impact mechanism carried in the handle of the termination tool.

Spaced slightly axially apart from the forward end of the torque/slide element is an annular groove which is sized to receive a C-spring. The C-spring has an end portion that extends slightly radially inwardly of the diameter of the C-spring and passes through a radial bore in the torque/slide. As a result, when the C-spring is installed in the annular groove and a screwdriver bit element is installed into the longitudinal bore of the torque/slide element, the end portion of the C-spring abuts against a bit-restraining detent in the screwdriver bit element. Each bit-restraining detent has a first tapered surface portion inclined a prescribed axial distance to a raised region. The detent is also axially indented from the raised region along a tapered surface to a region that is sized to accommodate the abutment of the end portion of the C-spring, thereby locking the screwdriver bit element in place.

To allow rapid insertion and removal of a screwdriver bit element relative to the torque/slide element, the screwdriver bit element preferably has first and second pairs of restraining detents oriented orthogonally with respect to one another and extending along the outer cylindrical surface of the screwdriver bit element from opposite endwalls thereof. The dowel is oriented at a 45° transverse diagonal relative to the detents, so that the end portion of the C-spring will be urged into abutment with surface region of a respective detent.

The forward surface end of the torque/slide element also has a pair of diametrically opposed slots, which are sized to receive a hardened steel retaining dowel that extends transversely through the screwdriver bit element. The retaining dowel pin serves the purpose of effectively prevent rotation of the screwdriver bit element relative to the torque/slide element, when the screwdriver bit element has been inserted into and captured by the torque/slide element. As a result, torque applied by means of the tool handle to the torque body portion of the torque/slide element is directly transferred to the screwdriver bit element.

The longitudinal interior torque/slide bore of the tool handle has a transverse cross-sectional shape corresponding to that of the torque body portion, so that the torque/slide element may be securely captured and rotated about the longitudinal axis of the tool for torque applications, and also be translated axially along the tool's longitudinal axis for impact/insertion applications. The diameter and shape of this bore accommodate the size and shape of the torque body portion of torque/slide element. A rear portion of the handle may be equipped with a storage cavity or auxiliary storage pouch for storage of termination blades and screwdriver bits.

Because the handle is typically made of a plastic, which can deform in response to the application of a rotational shear force about the longitudinal bore axis of the tool, a protective internal sleeve of hardened steel and fabricated is captured within the interior torque/slide bore and also surrounds and slidably captures the torque body portion of the torque/slide element. This allows the torque/slide element to either slide or be readily translated along the longitudinal bore axis by the operation of the impact element. The sleeve also enables the torque/slide element to be firmly held within the handle for torque applications, without subjecting the surrounding plastic material of the handle to 'cold flow' deformation, which may cause the handle to lose its original shape, resulting in binding of the torque/slide element and preventing a smooth return to its extended position after a termination is made.

DETAILED DESCRIPTION

As described briefly above, the present invention involves a modification of the slide element of a termination tool, which modification provides the slide element, and therefore the tool proper, with the auxiliary capability of imparting torque to an engageable hardware element, such as slotted end or cross point (Phillips) end screwdriver bit, so that the tool may be used to drive commonly used hardware fasteners.

Figure 2:
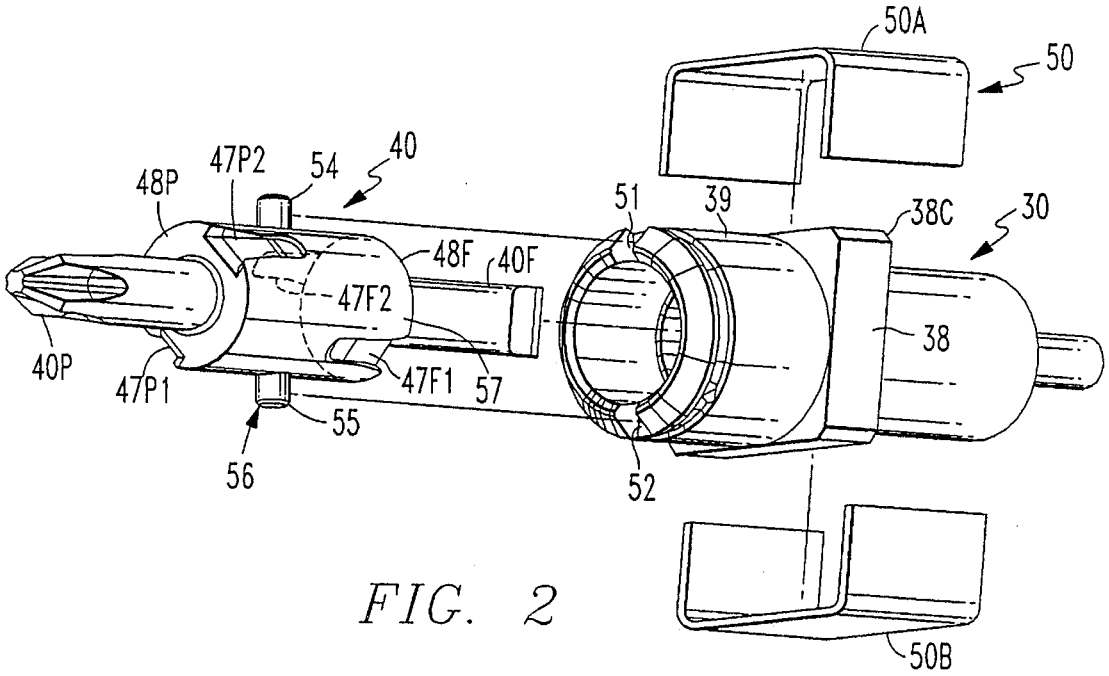
FIG. 2 diagrammatically illustrates an exploded assembly view of components of the improved termination tool in accordance with the present invention.

For this purpose, as diagrammatically illustrated in the exploded assembly view of FIG. 2, the improved termination tool in accordance with the present invention comprises a torque/slide element 30, a torque (double-ended screwdriver) bit element 40, shown as having two opposite end blades 40F and 40P, and a protective sleeve element 50, shown as having two sleeve halves 50A and 50B. As shown in cross-section in FIG. 3, the torque/slide element 30 may be configured essentially the same as a conventional slide element, such as that described in the above-referenced Mason et al patent, the torque/slide element 30 being metallic (e.g. steel) and generally cylindrically shaped and having a longitudinal axis 31 about which respective portions of the torque/slide element are substantially cylindrically symmetrical.

A forward annular end of the torque/slide element 30 has a chamfered surface 32 extending from the interior edge 33 of a longitudinal bore 34 having a first diameter portion 35 to a depth D35 along axis 31 from the forward end 32. Continuous with first diameter portion 35 of bore 34 is a second diameter portion 36 of a slightly reduced diameter relative to that of the first diameter portion 35, so as to form an interior annular shoulder region 37, against which screwdriver bit 40 may rest in its installed or captured position in the torque/slide element. Like torque/slide element 30, screwdriver bit 40 is preferably made of a hard and durable material such as steel. Second diameter portion 36 has a depth D36 along axis 31 sufficient to accommodate the length of an interior-facing one of the two opposing blade portions 40P, 40F of the screwdriver bit element 40, when the screwdriver bit 40 is installed in the torque/slide element.

Figure 1:
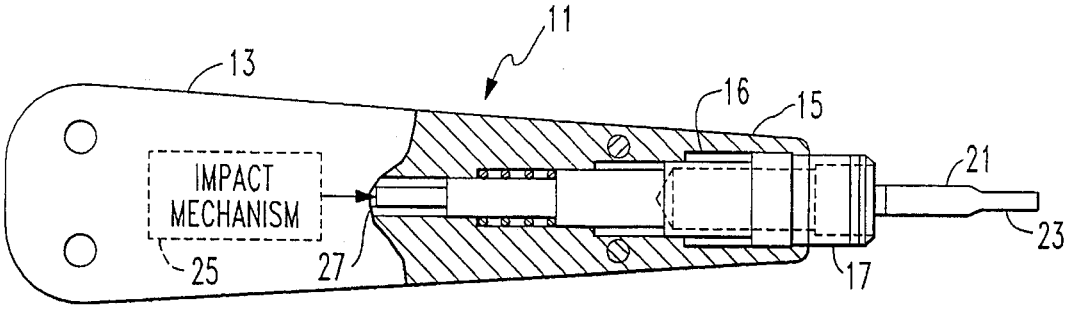
FIG. 1 (PRIOR ART)
FIG. 1 diagrammatically illustrates a non-limitative example of a conventional termination tool, corresponding to that described in the above-referenced Mason et al, U.S. Pat. No. 4,161,061.

Located generally axially midway along the length of torque/slide element 30 is a raised torque/slide body portion 38, that is solid with the outer cylindrical body 39 of the torque/slide element 30. The raised outer torque/slide body portion 38 preferably has a regular polygon shape, such as but not limited to a square, pentagon, hexagon and the like. The torque/slide body portion 38 has a differential outer diameter 38DD and an axial length 38L of sufficient to prevent unwanted play and maintain the torque/slide element 30 oriented along the longitudinal axial direction of the interior bore of the tool handle for both rotational (torque-applying) and longitudinal (axial impact-applying) applications of the tool. As further shown in cross-section in FIG. 3, a rearward or interior-positioned end of the torque/slide element 30 has a cylindrical pin portion 41, which is arranged to receive at 27 an axial blow from an impact mechanism, such as that shown diagrammatically at 25 in FIG. 1, referenced previously, and thereby cause a termination blade that has been inserted into and captured in torque/slide element 30 to insert a wire into a terminal engaged by the tool.

Adjacent to, but slightly axially displaced from, the chamfered forward surface end 32 of the torque/slide element 30 is an annular groove 42, which is sized to receive a C-spring 43. C-spring 43 has an end portion 44 that extends slightly radially inwardly of the diameter of the spring and passes through a radial bore 45 in the torque/slide element 30 so that, when the C-spring 43 is installed in annular groove 42 and the screwdriver bit element 40 is installed into the longitudinal bore of the torque/slide element 30, the end portion 44 of the C-spring abuts against a surface region 46 of a bit-restraining detent 47 in screwdriver bit element 40.

The chamfered forward surface end 32 of the torque/slide element 30 also has a pair of diametrically opposed slots 51 and 52, which are sized to receive respective opposite ends 54 and 55 of a hardened steel retaining dowel, or finger, 56 that extends transversely through the screwdriver bit element 40. Retaining dowel pin serves the purpose of effectively preventing rotation of the screwdriver bit element 40 relative to the torque/slide element 30 once the screwdriver bit element has been inserted into and captured by the torque/slide element 30. As a consequence, the application of torque to the torque/slide body portion 38 of the torque/slide element 30 (by means of the tool handle, to be described) is transferred directly to the screwdriver bit element 40, and thereby to a slotted or cross-point fastener into which a respective one of the blade ends 40P, 40F of the screwdriver bit element 40 has been inserted.

As described above, the end portion 44 of the C-spring is sized to abut against the surface region 46 of bit-restraining detent 47 in screwdriver bit element 40, when the C-spring 43 is installed in annular groove 42 and the screwdriver bit element 40 is inserted into the longitudinal bore of the torque/slide element 30. As shown in cross-sectional detail in FIG. 3, each bit-restraining detent 47 has a first tapered surface portion 49 having a first depth 49D into the outer cylindrical surface 57 of the torque bit element, tapered surface portion being inclined from depth 49D a prescribed axial distance along detent 47, to a bump or raised region 61. Detent 47 is further axially indented from bump 61 along a tapered surface region 63 to surface region 46 that is sized to accommodate the abutment of the end portion 44 of the C-spring 43, when the C-spring is captured in groove 45, thereby locking the screwdriver bit element 40 in place in the torque/slide element 30.

As shown in FIG. 2, in order to facilitate rapid insertion and removal of the screwdriver bit element 40 relative to the torque/slide element 30, the screwdriver bit element 40 preferably has first and second pairs of detents 47P1, 47P2 and 47F1, 47F2, oriented orthogonally with respect to one another and extending along the outer cylindrical surface of the bit element from opposite endwalls 48P and 48F thereof. Since the respective pairs of detents at opposite ends of the screwdriver bit element are radially oriented at 90° with respect to one another, orienting retaining dowel 56 at a 45° transverse diagonal relative to any one of the detents ensures that the dowel will be oriented at a 45° diagonal relative to each of detents 47P1, 47P2 and 47F1, 47F2, whenever the respective opposite ends 54 and 55 of retaining dowel 56 are captured in slots 51 and 52 of torque/slide element 30, so that the end portion 44 of the C-spring 43 will be urged into abutment with surface region 46 of a respective one of the detents.

In order to enable the torque/slide element 30 to be securely captured and rotated about the longitudinal axis 31 of the tool for torque applications, on the one hand, and be translated axially along longitudinal axis 31 for impact/insertion applications, on the other hand, the longitudinal bore of the handle into which the torque/slide element 30 is to be inserted, has a transverse cross-sectional shape corresponding to that of the torque/slide body portion 38.

Figure 3:
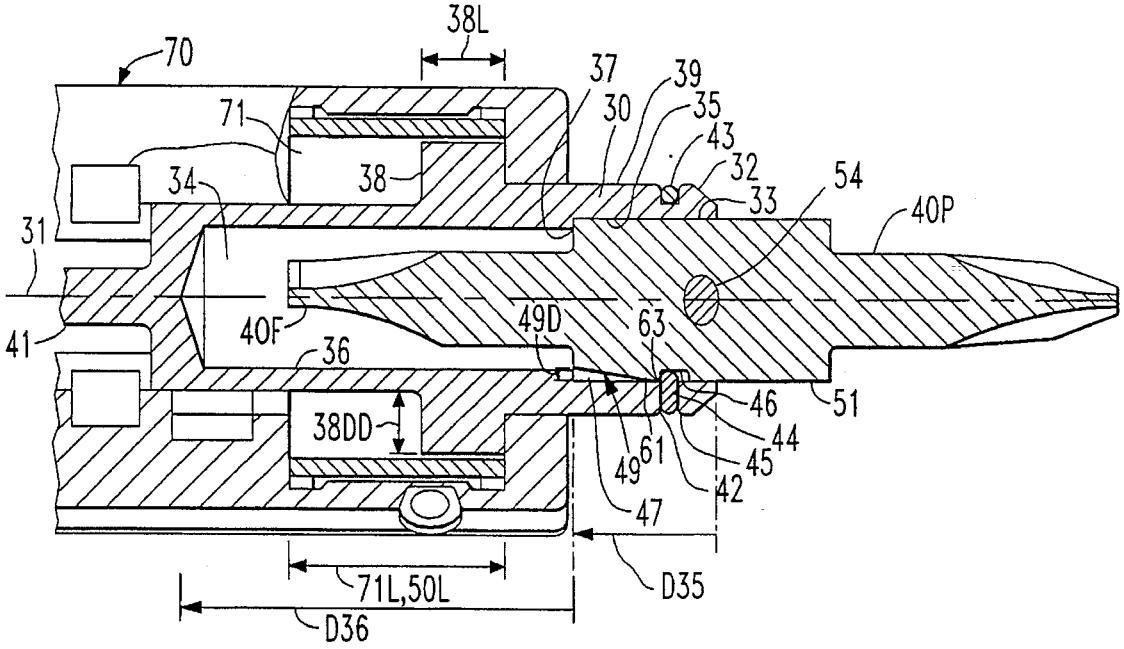
FIG. 3 is a cross-sectional view of a torque/slide element, showing its disposition within a protective sleeve in a torque/slide bore of a termination tool handle.

More particularly, as shown in the cross-sectional view of FIG. 3, the handle 70 has an interior torque/slide bore 71, the diameter and shape of which are sized to accommodate the size and geometrical configuration of the torque/slide body portion 38 of torque/slide element 30. Each of torque/slide body portion 38 and interior torque/slide bore 71 has the same polygonal cross-section. For purposes of a non-limiting example, each may have a square cross-section, as shown in cross-sectional end view of FIG. 4.

Figure 5:
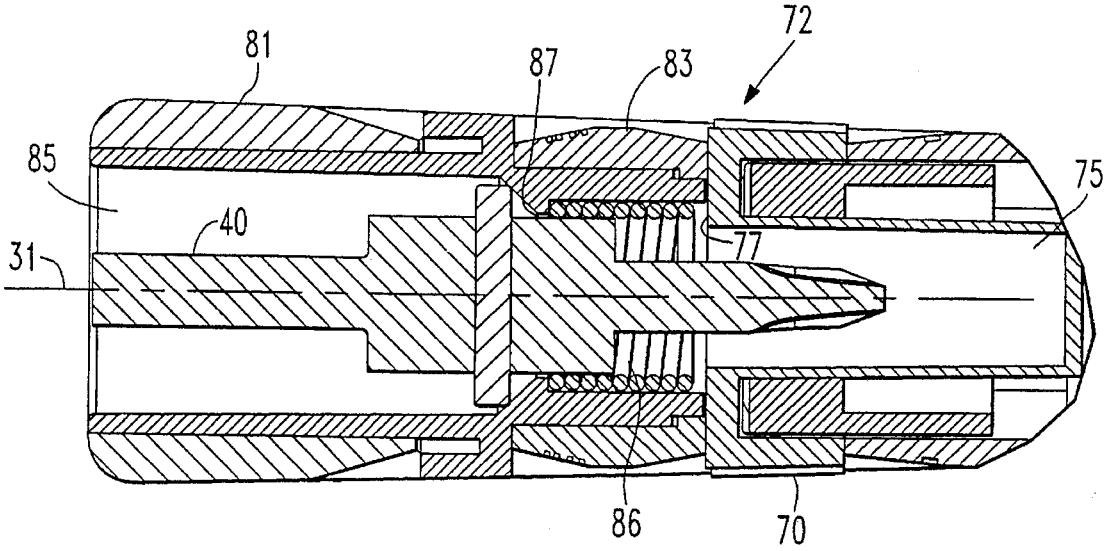
FIG. 5 diagrammatically illustrates a rear portion of an termination tool handle in accordance with the invention equipped with an auxiliary storage pouch.

As diagrammatically illustrated in FIG. 5, a rear portion 72 of the handle is preferably equipped with a storage compartment in the form of an internal storage cavity or has attached thereto an auxiliary storage pouch 81 of a sufficient interior diameter and depth to accommodate the storage of multiple termination blades and screwdriver bits. The storage pouch 81, which is preferably configured to conform with the rear of the handle 70, may be attached thereto by way of a sleeve fitting 83. The storage pouch 81 has a generally cylindrical interior cavity or bore 85 that is coaxial with axis 31 of the tool and is coextensive with a longitudinal bore 75 at the rear portion of the handle, so as to allow a screwdriver bit 40 to be retained by the pouch. The pouch may also include a compression spring 86 into which bit 40 is inserted and held during storage, as shown. Compression spring 86 is captured between an annular interior shoulder 87 of cavity 85 and a rear wall 77 of handle 70.

Figure 4:
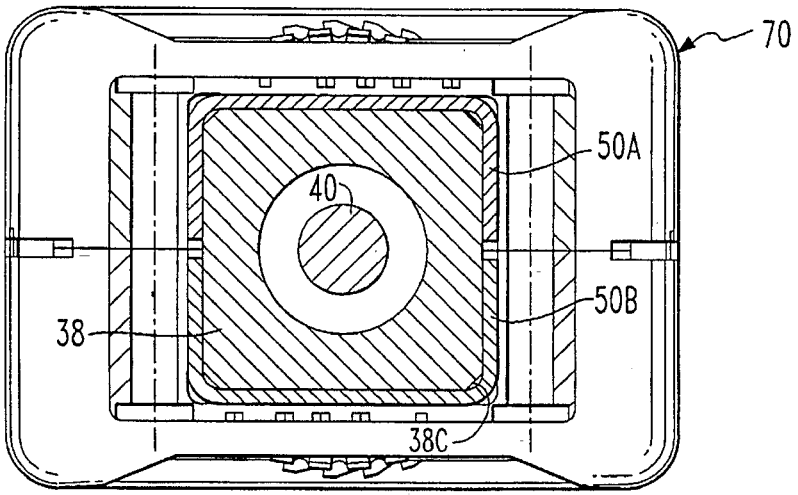
FIG. 4 is a cross-sectional end view of a torque/slide element captured in a termination tool handle.

As pointed out previously, because the handle 70 itself is typically made of a plastic material, which can be expected to deform in response to the application of a substantial rotational shear force about the longitudinal bore axis 31, a protective internal sleeve 50, preferably made of hardened steel and fabricated in two pieces 50A and 50B, as shown in FIGS. 2 and 4, is sized to fit and nest within interior torque/slide bore 71, and also surround and slidably capture the torque/slide body portion 38 of torque/slide element 30. Namely, when mounted within interior torque/slide bore 71, the two halves 50A and 50B of protective sleeve 50 effectively form a solid shroud which, on the one hand, allows the torque/slide element 30 to slide or be readily translated along the longitudinal bore axis 31 by the operation of the impact element. On the other hand, sleeve 50 enables the torque/slide element 30 to be firmly held within the handle for torque applications, without subjecting the surrounding plastic material of the handle 70 to 'cold flow' deformation, which may cause the handle to lose its original shape, resulting in binding of the torque/slide element 30 and preventing a smooth return to its extended position after a termination is made.

As mentioned briefly above, torque/slide body portion 38 has differential outer diameter and axial length that prevent undue play and are sufficient to maintain the torque/slide element 30 oriented parallel to and along the longitudinal axial direction of the interior bore of the tool handle for both rotational (torque-applying) and longitudinal (axial impact-applying) applications of the tool. In accordance with a preferred embodiment of the invention, the lengths 71L and 50L of the interior torque/slide bore 71 and the protective sleeve 50, respectively, is greater than, and may be on the order of three times the axial length 38L of the raised torque/slide body portion 38. This will provide a sufficient length of axial travel of the torque/slide element 30. In addition, it is preferred that the torque/slide body portion 38 have smooth radius corners 38C, to allow relatively smooth axial travel along the interior surfaces of protective sleeve 50.

When the two halves of the modified termination tool according to the present invention are assembled in the manner described above, such that the torque/slide element 30 is slidably captured within the two halves 50A and 50B of protective sleeve 50 which, in turn are securely retained in interior torque/slide bore 71 of handle 70, the slide element is now ready to accept either a termination blade (of the type described in the above-referenced Mason et al patent, for example) for termination applications, or the screwdriver bit 40, for torque applications.

As will be appreciated from the foregoing description, the previously described desirability of providing a termination tool with the auxiliary capability of providing torque to an engageable hardware element is successfully achieved in accordance with the present invention by modifying the slide element and handle bore portions of a termination tool, such as that described in the above-referenced Mason et al patent, to add an outer torque/slide body portion to the slide element, which provides the slide element, and therefore the tool proper, with the auxiliary capability of imparting torque to an engageable hardware element, such as slotted end or cross-point end screwdriver bit, thereby enabling the tool used to drive commonly used hardware fasteners.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A termination tool of the type used to connect an electrical conductor to a terminal element, said termination tool comprising a torque and slide element configured so that said torque and slide element may be selectively axially translated in the direction of an axis of said termination tool and may be selectively rotated about said axis of said termination tool, said torque and slide element having an interior longitudinal bore that is sized to receive and capture a selected one of a termination blade and a torque bit element at a first, external end thereof, and being coupled to receive an axial impact from an impact device at a second, interior end thereof, said torque and slide element having a raised body portion solid with an outer body portion thereof, and a handle containing an impact device, which is operative to apply an impact force to said second, interior end of said torque and slide element, said handle further having an interior bore sized to accommodate said raised body portion of said torque and slide element, and further including a protective sleeve, which surrounds said raised body portion of said torque and slide element, and wherein said interior bore of said handle is sized to capture said protective sleeve surrounding said raised body portion of said torque and slide element, and wherein each of said raised portion of said torque and slide element and said protective sleeve captured in said interior bore of said handle has the same regular polygon shape, and wherein said raised body portion of said torque and slide element has smooth radius corners and a length less than the length of said interior bore and said protective sleeve, so as to allow relatively smooth axial translation of said raised body portion of said torque and slide element along interior surfaces of said protective sleeve within said interior bore of said handle.

2. A termination tool according to claim 1, wherein said raised body portion of said torque and slide element has a length on the order of one-third the length of said interior bore and said protective sleeve.

3. A termination tool which captures and receives a selected one of a torque bit element, and a termination blade of the type used to connect an electrical conductor to a terminal element, said termination tool comprising a torque and slide element configured so that said torque and slide element may be selectively axially translated in the direction of an axis of said termination tool and may be selectively rotated about said axis of said termination tool, said torque and slide element having an interior longitudinal bore receives and captures said torque bit element at a first, external end thereof, and being coupled to receive an axial impact from an impact device at a second, interior end thereof, said torque and slide element having a raised body portion solid with an outer body portion thereof, and a handle containing an impact device, which is operative to apply an impact force to said second, interior end of said torque and slide element, said handle further having an interior bore sized to accommodate said raised body portion of said torque and slide element, and wherein an outer surface of said torque bit element has a detent, and wherein said torque and slide element has an annular groove which is sized to receive a C-spring, said C-spring having an end portion that extends slightly radially inwardly of the diameter of said C-spring and passes through a radial bore in said torque and slide element, so that said end portion of said C-spring abuts against said detent in said torque bit element, and wherein said first, external end of said torque and slide element includes a slot that is sized to receive a retaining element that extends transversely from said torque bit element, and thereby prevents rotation of said torque bit element relative to said torque and slide element.

4. A termination tool according to claim 3, wherein a detent extends along the outer surface of said torque bit element from an endwall thereof, and wherein said retaining element is oriented at a transverse diagonal relative to said detent.

5. A termination tool according to claim 3, wherein said wherein said first, external end of said torque and slide element includes a plurality of slots that are sized to receive respective retaining elements that extend transversely from said torque bit element, and thereby prevent rotation of said torque bit element relative to said torque and slide element.

6. A termination tool according to claim 5, wherein said torque bit element has a plurality of detents extending along the outer surface of said bit element from opposite endwalls thereof, and wherein said respective retaining elements are oriented at a transverse diagonal relative to one of said detents of said first and second pairs.

7. A termination tool according to claim 6, wherein said plurality of detents are oriented orthogonally with respect to one another.

8. A termination tool which captures and receives a selected one of a torque bit element, and a termination blade of the type used to connect an electrical conductor to a terminal element, said termination tool comprising a slide element having an interior longitudinal bore receives and captures said torque bit element at a first end thereof, and being coupled to receive an axial impact from an impact device at a second end thereof, said slide element having a raised surface body portion at an outer surface thereof, a protective sleeve member surrounding said raised surface body portion of said slide element, and a handle containing an impact device which is operative to apply an impact force to said second end of said slide element, said handle further having an interior bore sized to capture said protective sleeve member and said raised surface portion of said slide element surrounded by said protective sleeve member, and wherein each of said raised surface body portion of said slide element and said protective sleeve member captured in said interior bore of said handle has a like regular polygonal cross-section, and wherein said torque bit element comprises a double-ended screwdriver bit element, and wherein an outer surface of said double-ended screwdriver bit element has a detent, and wherein said slide element has an annular groove which is sized to receive a C-spring, said C-spring having an end portion that extends slightly radially inwardly of the diameter of said C-spring and passes through a radial bore in said slide element, so that said end portion of said C-spring is urged against said detent in said double-ended screwdriver bit element, and wherein said first end of said slide element further includes a slot sized to receive a retaining element that extends transversely from said double-ended screwdriver bit element, and thereby prevents rotation of said double-ended screwdriver bit element relative to said slide element.

9. A termination tool according to claim 8, wherein said first end of said slide element further includes a plurality of slots sized to receive retaining elements that extend transversely from said double-ended screwdriver bit element, and thereby prevent rotation of said double-ended screwdriver bit element relative to said slide element.

10. A termination tool according to claim 8, wherein said outer surface of said double-ended screwdriver bit element has a plurality of detents, and wherein end portion of said C-spring is urged against one of said plurality of detents in said double-ended screwdriver bit element.

11. A termination tool according to claim 10, wherein said detents of said plurality along the outer surface of said double-ended screwdriver bit element include detents that are oriented orthogonally with respect to one another.

12. A termination tool of the type used to connect an electrical conductor to a terminal element, said termination tool comprising a slide element having an interior longitudinal bore sized to receive and capture a selected one of a termination blade and a torque bit element at a first end thereof, and being coupled to receive an axial impact from an impact device at a second end thereof, said slide element having a raised surface body portion at an outer surface thereof, a protective sleeve member surrounding said raised surface body portion of said slide element, and a handle containing an impact device which is operative to apply an impact force to said second end of said slide element, said handle further having an interior bore sized to capture said protective sleeve member and said raised surface portion of said slide element surrounded by said protective sleeve member, and wherein each of said raised surface body portion of said slide element and said protective sleeve member captured in said interior bore of said handle has a like regular polygonal cross-section, and wherein said raised surface body portion of said slide element has smooth radius corners, so as to allow relatively smooth axial travel thereof along interior surfaces of said protective sleeve.

13. A tool comprising a body and a tool element coupled thereto, said body having a generally cylindrical bore, a first end of said body including a plurality of slots sized to receive respective ones of a plurality of retaining elements that extend transversely from said tool element, said slots in said body, when receiving said retaining elements of said tool element, preventing rotation of said tool element relative to said body, and wherein said first end of said body further includes an annular groove which is sized to receive a C-spring, said C-spring having an end portion that extends slightly radially inwardly of the diameter of said C-spring and passes through a radial bore in said body, so that said end portion of said C-spring abuts against said detent in said tool element, and wherein said tool element includes a plurality of detents extending along outer surfaces of said tool element from opposite endwalls thereof, and wherein said plurality of retaining elements of said tool element are oriented at a transverse diagonal relative to one of said detents of said plurality of detents.

14. A tool according to claim 13, wherein said plurality of detents includes detents oriented orthogonally with respect to one another along the outer surface of said tool element.

* * * * *